US006841751B2

(12) United States Patent
Sasaki et al.

(10) Patent No.: US 6,841,751 B2
(45) Date of Patent: Jan. 11, 2005

(54) SWITCHING DEVICE

(75) Inventors: Makoto Sasaki, Miyagi-ken (JP); Kenji Sawada, Auburn Hills, MI (US)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/436,355

(22) Filed: May 12, 2003

(65) Prior Publication Data

US 2004/0011636 A1 Jan. 22, 2004

(30) Foreign Application Priority Data

May 14, 2002 (JP) ..... 2002-139046

(51) Int. Cl.[7] ..... H01H 21/00
(52) U.S. Cl. ..... 200/553; 200/563; 200/5 R
(58) Field of Search ..... 200/553–567, 200/252, 253, 560–563, 5 R, 6 R, 6 C, 339

(56) References Cited

U.S. PATENT DOCUMENTS 4,654,487 A * 3/1987 Sawada ..... 200/1 V
5,258,593 A * 11/1993 Hayakawa ..... 200/315
5,265,716 A 11/1993 Sawada et al.
5,510,583 A * 4/1996 Pescetto ..... 200/1 B
5,735,392 A * 4/1998 Shirasaka ..... 200/553
5,901,839 A * 5/1999 Sasaki et al. ..... 200/551
6,091,038 A * 7/2000 Murphy et al. ..... 200/563
6,388,220 B1 * 5/2002 Sasaki et al. ..... 200/537
6,610,945 B2 * 8/2003 Onodera ..... 200/315

OTHER PUBLICATIONS

U.S. patent application Ser. No. 10/844,141, Takata et al., filed May 12, 2004.

* cited by examiner

*Primary Examiner*—Lincoln Donovan
*Assistant Examiner*—M. Fishman
(74) *Attorney, Agent, or Firm*—Brinks Hofer Gilson & Lione

(57) ABSTRACT

A switching device includes three stationery contacts fixed to a casing and exposed on a bottom wall of casing, a conductive plate swingable about the central contact as a fulcrum and coming into contact with or detached from one of the other contacts, a drive body disposed on the conductive plate so as to be movable upwards and downwards and turnable about a shaft thereof, and a leaf spring elastically urging the shaft towards the bottom wall. The drive body has a pressing actuator protruding sidewards from the casing. When the pressing actuator is pressed by an operating knob so as to turn the drive body by a predetermined amount, a sliding actuator of the drive body slides on the conductive plate so as to turn the conductive plate. When the drive body is turned by another predetermined amount, the pressing actuator actuates a push-switch disposed near the casing.

10 Claims, 7 Drawing Sheets

SWITCHING DEVICE

BACKGROUND OF THE INVENTION

1. Field of the Invention

The present invention relates to switching devices which are operated in a swinging manner and more particularly it relates to a switching device which outputs two-position change-over signals with a consecutive pressing operation and which is suitable for use in a drive switch of a car-mounted automatic widow apparatus and the like.

2. Description of the Related Art

FIG. 12 is a sectional view of a known switching device of the above-mentioned type. As shown in the figure, a casing 1 having a bottom wall 1*a* has first, second, and third stationery contacts 2*a*, 2*b*, and 2*c* fixed therein by insert-molding and has three terminals 8 extending from the corresponding stationery contacts 2*a* to 2*c* and protruding downwards from the casing 1. Each of the stationery contacts 2*a* to 2*c* is exposed on the bottom wall 1*a* of the casing 1 and the central stationery contact 2*a* has a conductive plate 3 swingably disposed thereon, serving as a fulcrum thereof. The conductive plate 3 made from a metal plate and having an approximate M-shape in side view includes a crest portion 3*a* and a pair of rising portions 3*b* and 3*c* at both sides of the crest portion 3*a*, and the longitudinal two ends of the conductive plate 3 are respectively contactable with the stationery contacts 2*b* and 2*c*. The conductive plate 3 has an actuator 4*a* of a drive body 4 disposed thereon. Since the drive body 4 is constantly urged towards the bottom wall la by a coil spring 5, the actuator 4*a* lies in elastic contact with the conductive plate 3. The drive body 4 and the coil spring 5 are incorporated into a recess 6*a* of a turning lever 6. The turning lever 6 is turnably supported by a cover 7 fixed to the casing 1 so as to cover the casing 1, and an operating knob (not shown) is fixed to the turning lever 6. The operating knob is operated in a swinging manner by an operator. When the turning lever 6 is turned in conjunction with the swinging of the operating knob, the actuator 4*a* of the drive body 4 slides on the conductive plate 3.

FIG. 12 illustrates a non-operational state of the known switching device in which the turning lever 6 is not turned, and the stationery contacts 2*a* and 2*c* are electrically connected with each other via the conductive plate 3 while the stationery contacts 2*a* and 2*b* remain in a switched-off state. In this state, when the turning lever 6 is turned clockwise in the figure by pressing the operating knob, since the actuator 4*a* slides on the rising portion 3*b* while compressing the coil spring 5, the conductive plate 3 turns counterclockwise in the figure upon the actuator 4*a* passing through the stationery contact 2*a*. As a result, since the conductive plate 3 is detached from the stationery contact 2*c* and comes into contact with the stationery contact 2*b*, the stationery contacts 2*a* and 2*b* are electrically connected with each other via the conductive plate 3 and are thus changed to a switched-on state. When the pressing force exerted on the turning lever 6 is removed, since the restoring force of the coil spring 5 causes the actuator 4*a* to slide on the rising portion 3*b* in the reverse direction, the conductive plate 3 turns in the reverse direction upon the actuator 4*a* passing through the stationery contact 2*a* and returns to the state shown in FIG. 12, and thus the stationery contacts 2*a* and 2*b* return automatically to a switched-off state.

Also, in the state shown in FIG. 12, when the turning lever 6 is turned counterclockwise in the figure by pressing the operating knob, although the actuator 4*a* slides on the rising portion 3*a*, since the conductive plate 3 has previously been pressed against the stationery contact 2*c*, it does not turn; hence the stationery contacts 2*a* and 2*b* remain in a switched-off state.

When two groups of the stationery contacts 2*a* to 2*c* are disposed in two rows on the bottom wall 1*a* of the casing 1, and the conductive plate 3, the actuator 4*a*, and the other parts are disposed for each group of the stationery contacts 2*a* to 2*c*, two sets of switching elements sharing the casing 1 and the turning lever 6 can be disposed side by side. Accordingly, by disposing these two sets of switching elements so as to be symmetric with respect to a point in plan view, a double-pole double-throw switching device in which, when the operating knob is pressed into one direction, one of the switching elements outputs a first drive signal, and when the operating knob is pressed into the other direction, the other switching element outputs a second drive signal can be achieved.

Such a switching device has been widely used as a drive switch of a car-mounted automatic window apparatus. In this case, since the drive signal for performing an operation of opening or closing a window can be output while the operating knob is being pressed, a manual operation by which the degree of opening of the window can be set as desired can be performed.

The drive switch of a car-mounted automatic window is also required to have an operational function of fully opening or closing the window through one-touch operation. In order to additionally provide such an operational function to the foregoing switching device, the switching device usually has a push-switch (a tactile switch) disposed next thereto, which is operated by pressing in conjunction with the turning of the turning lever 6. Such an example known switching device has a structure in which a pressing drive rod is disposed so as to protrude downwards, passing through the bottom wall 1*a* of the casing 1, and when the turning lever 6 is turned by a large amount, the pressing drive rod is pressed down so as to actuate the push-button; alternatively, another structure in which a pressing drive body is disposed so as to protrude sidewards from the casing 1, and when the turning lever 6 is turned by a large amount, the pressing drive body actuates the push-button. In such an example known switching device, the operating knob is pressed down so as to turn the turning lever 6 by a predetermined amount and to cause the conductive plate 3 to come into contact with the stationery contact 2*b* which has been kept away from the conductive plate 3, and then the turning lever 6 is further turned by another predetermined amount by further pressing down the operating knob. With this operation, the pressing drive rod or the pressing drive body is pressed down by the turning lever 6 so as to actuate an operating unit of the push-switch by pressing, so that a drive signal for performing an operation of fully opening or closing the window is output.

In the known switching device shown in FIG. 12, in order for the actuator 4*a* of the drive body 4 to swing the conductive plate 3, the turning center of the turning lever 6 for driving the drive body 4 must be set away from the conductive plate 3 to a certain extent; hence, the turning lever 6 for storing the drive body 4 and the coil spring 5 is required to have a reasonable size, thereby constituting a limiting factor of reducing the overall size and thickness of the switching device. Accordingly, as described above, when a pressing drive rod or a pressing drive body for actuating a push-switch is additionally disposed in such a switching device, the overall switching device including the pressing drive rod protruding downward or the pressing drive body protruding sidewards becomes considerably large and also its structure becomes complicated.

When the known switching device shown in FIG. 12 is assembled, the drive body 4 incorporated into the recess 6*a* of the turning lever 6 together with the coil spring 5 must be disposed on the conductive plate 3 in the casing 1; however, since this assembling step must be carefully performed such that the drive body 4 and the coil spring 5 do not drop off from the turning lever 6, the switching device is difficult to assemble. As a result, when a pressing drive rod or a pressing drive body for actuating a push-switch is additionally disposed in such a switching device, the switching device becomes more difficult to assemble, thereby leading to a reduced productivity.

SUMMARY OF THE INVENTION

In view of the problems of the conventional art, the present invention has been made. Accordingly, it is an object of the present invention to provide a switching device which has a compact, thin, and simple structure and is easy to assemble.

In order to achieve the above-mentioned object, a switching device according to the present invention includes a casing including at least one pair of opposing sidewalls formed on a bottom wall thereof in a standing manner; at least one group of stationery contacts fixed to the casing and exposed on the bottom wall; at least one conductive plate swingably disposed above the bottom wall and coming into contact with or detached from at least one of the stationery contacts; at least one drive body which is disposed on the conductive plate so as to be movable upwards and downwards and which is turnable about a shaft of the drive body; and at least one spring elastically urging the shaft of the drive body towards the bottom wall. The drive body includes a sliding actuator slidable on a sloped surface of the conductive plate and a pressing actuator protruding sidewards from the casing, and the pressing actuator is disposed so as to oppose an operating unit of a push-switch disposed in the vicinity of the casing.

In the switching device having the above-mentioned structure, since the spring elastically urges the shaft of the drive body towards the bottom wall of the casing, when a pressing operation force is exerted, via an operating knob, on the pressing actuator of the drive body protruding sidewards from the casing, the sliding actuator of the drive body slides on the sloped surface of the conductive plate in conjunction with the turning of the drive body so as to turn the conductive plate. That is, the pressing actuator of the drive body can be directly pressed by the operating knob. Accordingly, since no other drive member for causing the conductive plate to come into contact with or to be detached from one of the stationery contacts is required to be interposed between the drive body and the operating knob, and also the spring can be disposed in a narrow space above the drive body, the overall structure of the switching device can be easily made thin. Also, since the push-switch disposed in the vicinity of the casing is actuated by the pressing actuator which is pressed down by the operating knob, no additional drive member for the push-switch is required to be disposed, thereby leading to a compact, thin, and simple structure. In addition, since the conductive plate, the drive body, and the spring are built on the bottom wall of the casing in that order, the switching device is easy to assemble.

In the switching device having the above-mentioned structure, preferably, the conductive plate includes a base for supporting the drive body which has no pressing operation force acted thereon; a rising portion continuously extending from the base and having the sloped surface formed thereon; and a movable contact which extends from the end of the rising portion towards the other side of the base and which is contactable with any one of the stationery contacts. In this case, when the pressing actuator which extends from the shaft of the drive body disposed on the conductive plate and which protrudes towards the opposite side of the movable contact is pressed down by the operating knob, the sliding actuator of the drive body slides on the rising portion so as to turn the conductive plate so that the movable contact comes into contact with the predetermined stationery contact. Also, when the pressing operation force is removed after the conductive plate is turned, since the restoring force of the spring causes the sliding actuator to slide on the rising portion in the reverse direction, the conductive plate is turned in the reverse direction so as to return to its initial position. Meanwhile, the sliding actuator of the drive body is not required to slide on a portion of the conductive plate, which extends from the base of the conductive plate in the opposite direction of the rising portion, the portion of the conductive plate on which the drive body does not slide suffices to have a flat shape, thereby allowing the conductive plate to have a relatively small length and to be easily processed. Furthermore, the group of stationery contacts preferably includes a first stationery contact, serving as a fulcrum of the conductive plate and always remaining in contact with the conductive plate, and a second stationery contact which comes into contact with or is detached from the movable contact. In addition, the group of stationery contacts may further include a third stationery contact which comes into contact with or is detached from a portion of the conductive plate, which extends from the base towards the other side of the rising portion.

Also, in any one of the above-mentioned structures, the casing may have two sets of switching elements disposed therein side by side, each including the group of stationery contacts, the conductive plate, the drive body, and the spring. This structure provides a double-pole double-throw switching device in which one of the switching elements outputs a first drive signal when the operating knob is pressed into one direction and the other switching element outputs a second drive signal when the operating knob is pressed into the other direction. In this case, preferably, the two groups of stationery contacts, the two conductive plates, and the two drive bodies of the two sets of switching elements are respectively disposed so as to be symmetric with respect to a point in plan view. Also, in the switching device having the foregoing structure, preferably, the casing has an opening opposing the bottom wall; each of a plurality of the corresponding sidewalls, which are disposed in the casing in a standing manner so as to be parallel to each other, has a depression formed so as to be open towards the opening and having the shaft of the corresponding drive body inserted therein so as to be movable upwards and downwards; and each of another plurality of the corresponding sidewalls, which are disposed in the casing so as to be at a right angle with the former sidewalls, has a slit formed so as to be open towards the opening and having a portion of the corresponding drive body for supporting the pressing actuator inserted therein so as to be movable upwards and downwards. With this structure, the overall structure of the switching device is easily made thin.

DESCRIPTION OF THE PREFERRED EMBODIMENT

Figure 1:
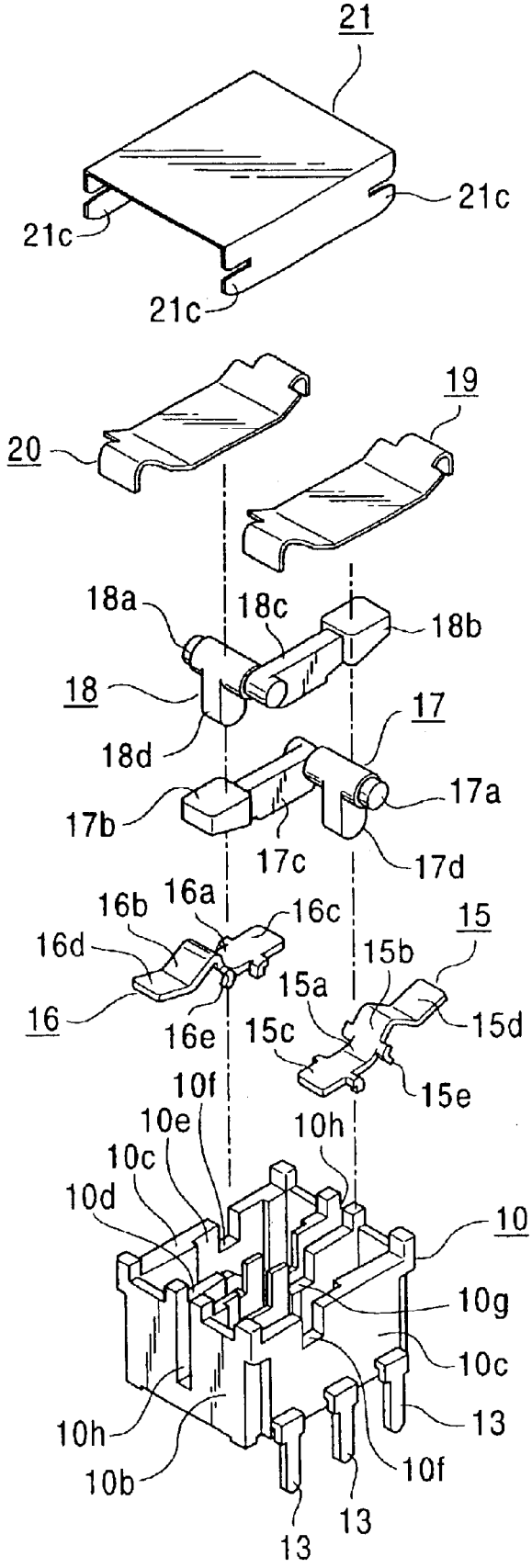
FIG. 1 is an exploded perspective view of a switching device according to an embodiment of the present invention.
Figure 2:
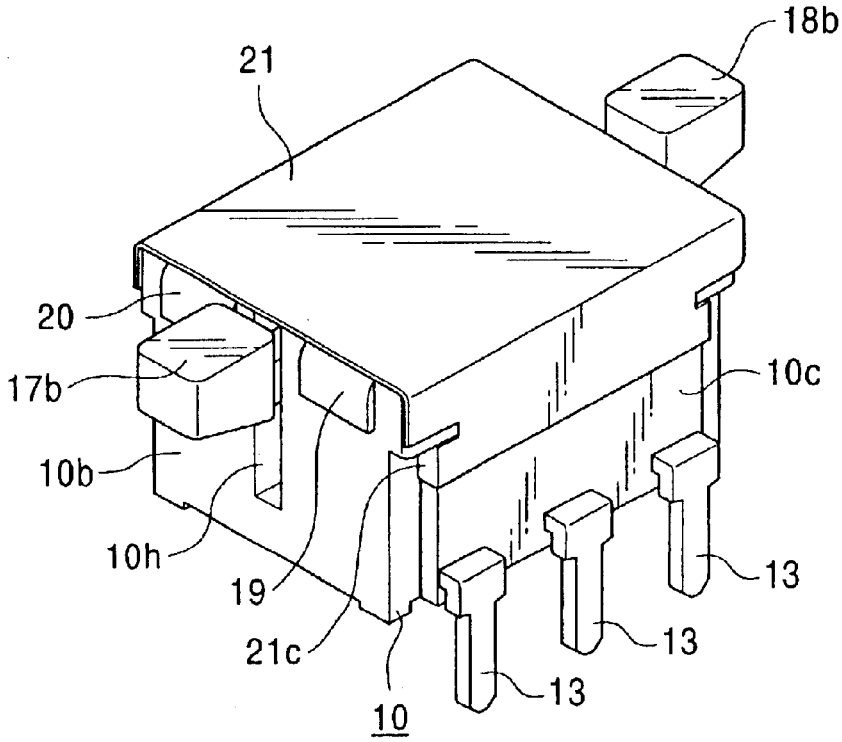
FIG. 2 is a perspective view of the switching device.
Figure 3:
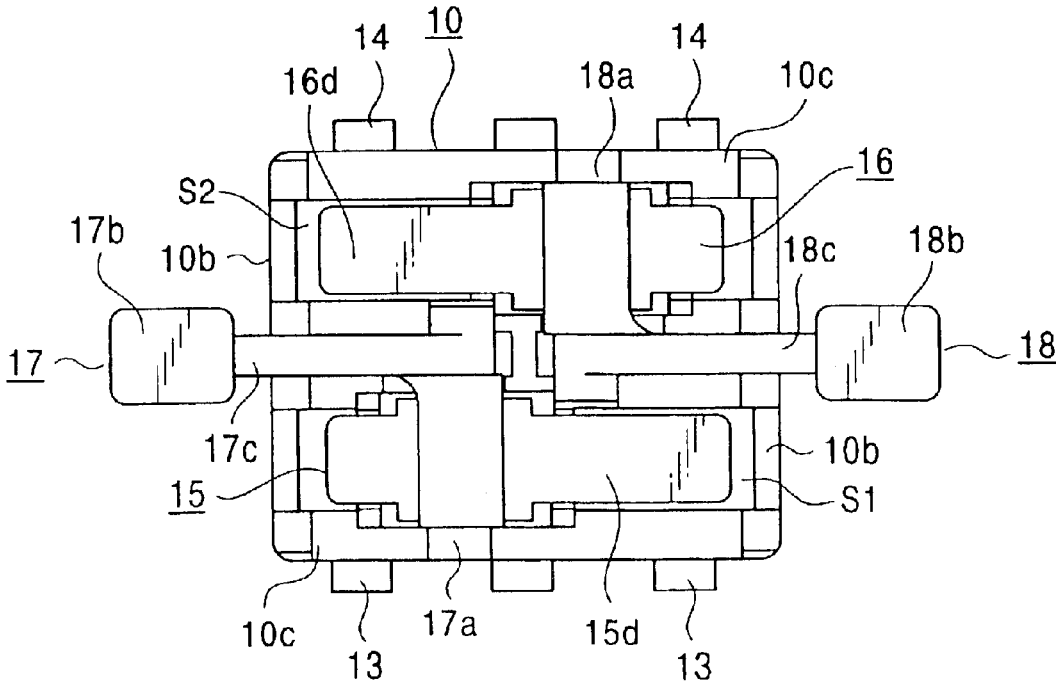
FIG. 3 is a plan view of the switching device in which a cover and a leaf spring are omitted.
Figure 4:
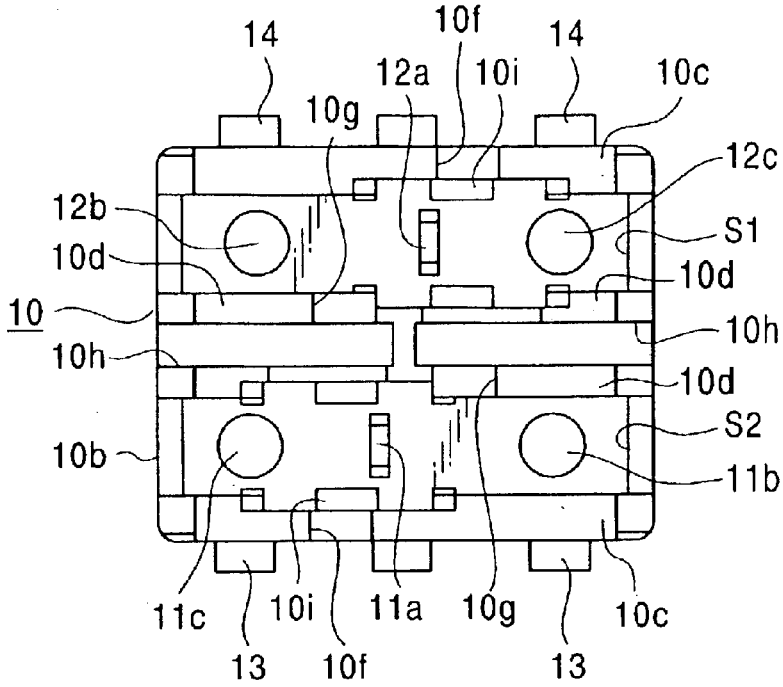
FIG. 4 is a plan view of a casing used for the switching device.
Figure 5:
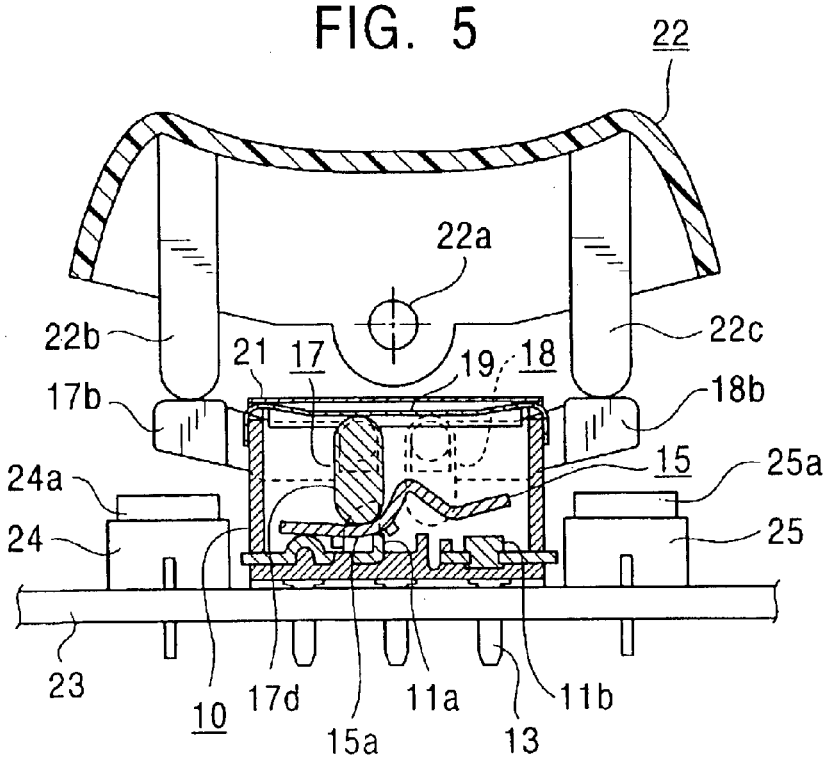
FIG. 5 illustrates a non-operational state of the switching device.
Figure 6:
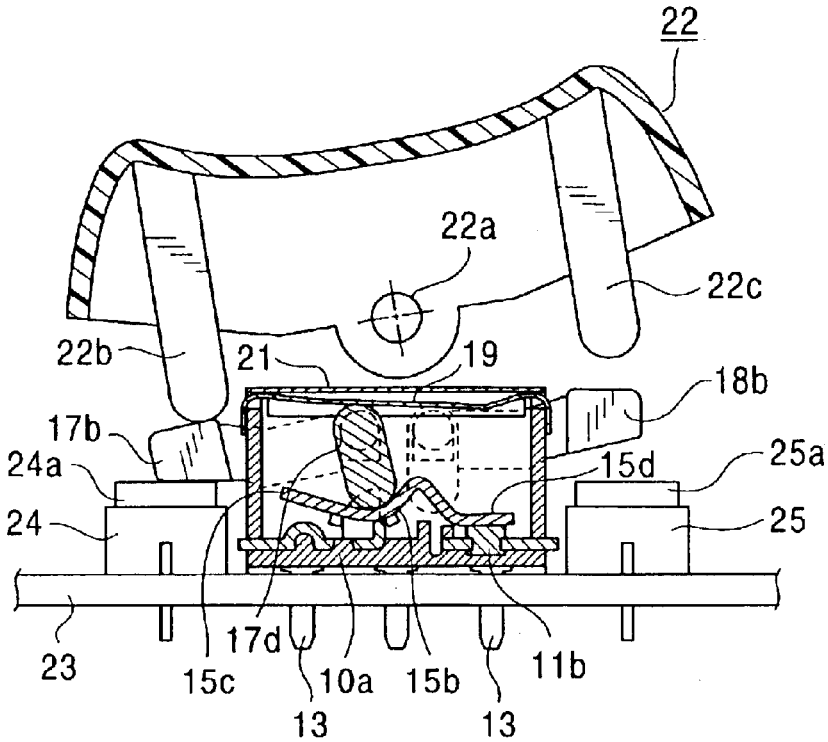
FIG. 6 illustrates the state in which a conductive plate is turned by operating the switching device.
Figure 7:
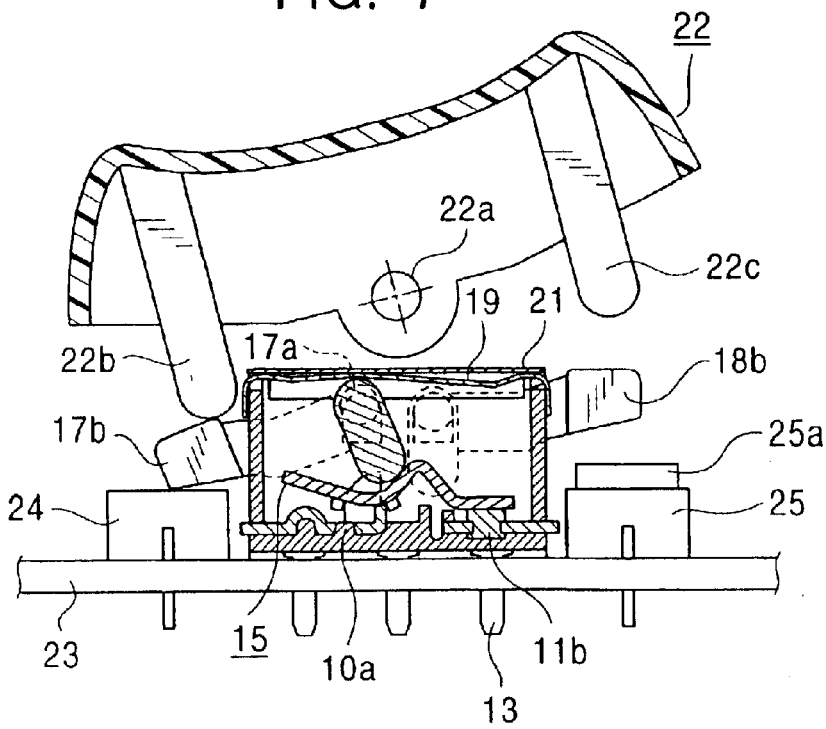
FIG. 7 illustrates the state in which a push switch is actuated by operating the switching device.
Figure 8:
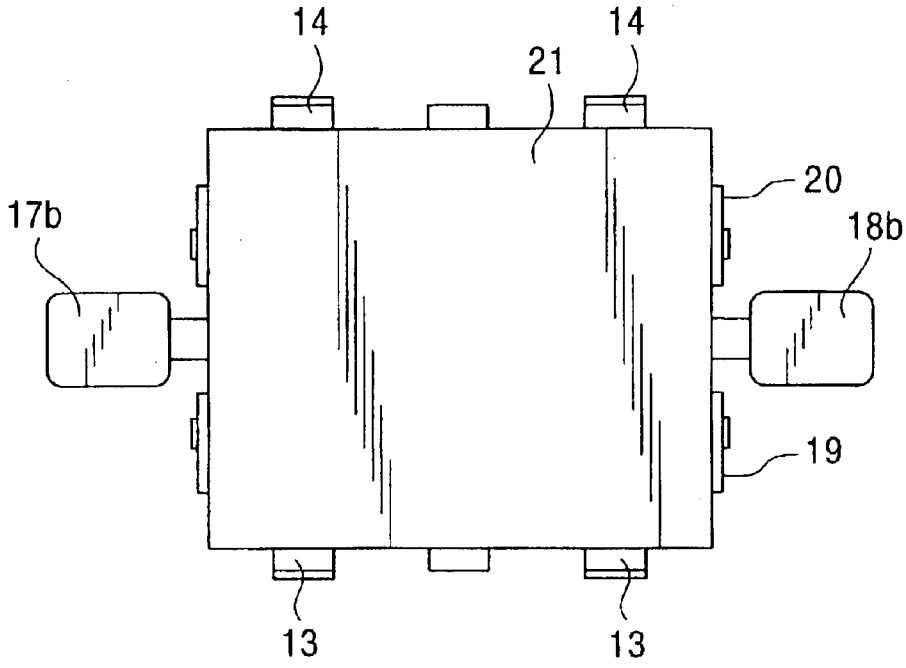
FIG. 8 is a plan view of the switching device.
Figure 9:
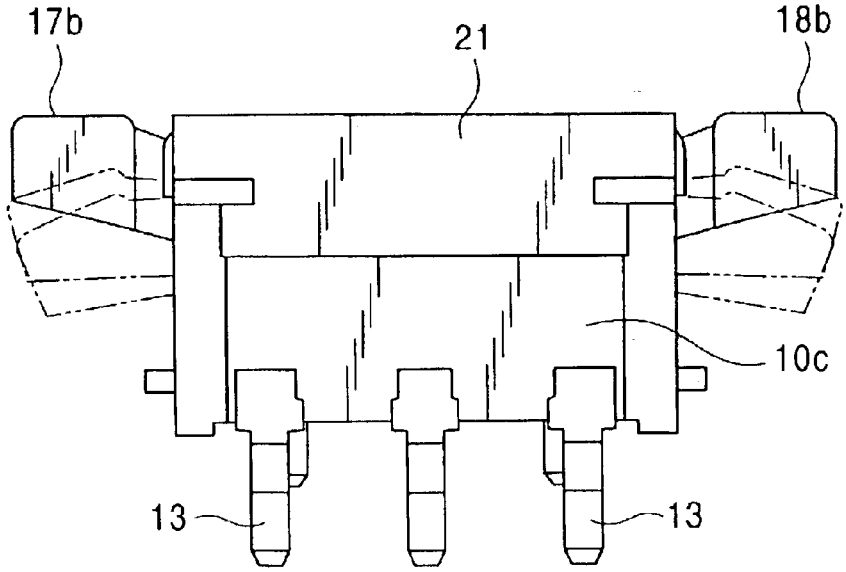
FIG. 9 is a side view of the switching device viewed from its long side.
Figure 10:
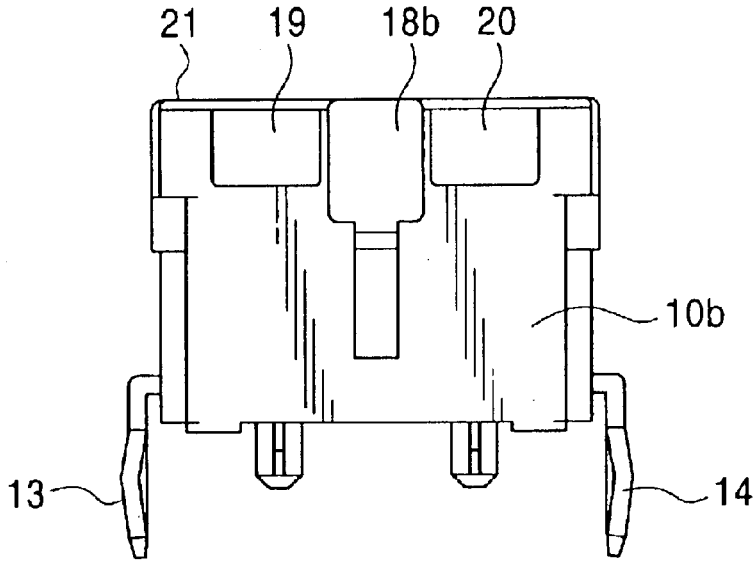
FIG. 10 is a side view of the switching device viewed from its short side.
Figure 11:
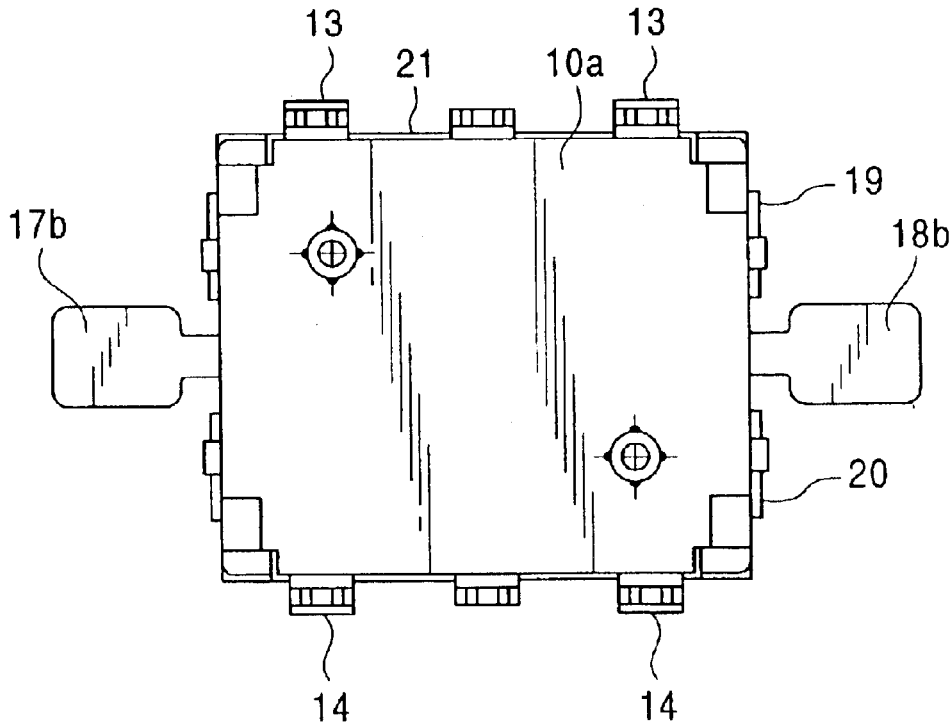
FIG. 11 is a bottom view of the switching device.
Figure 12:
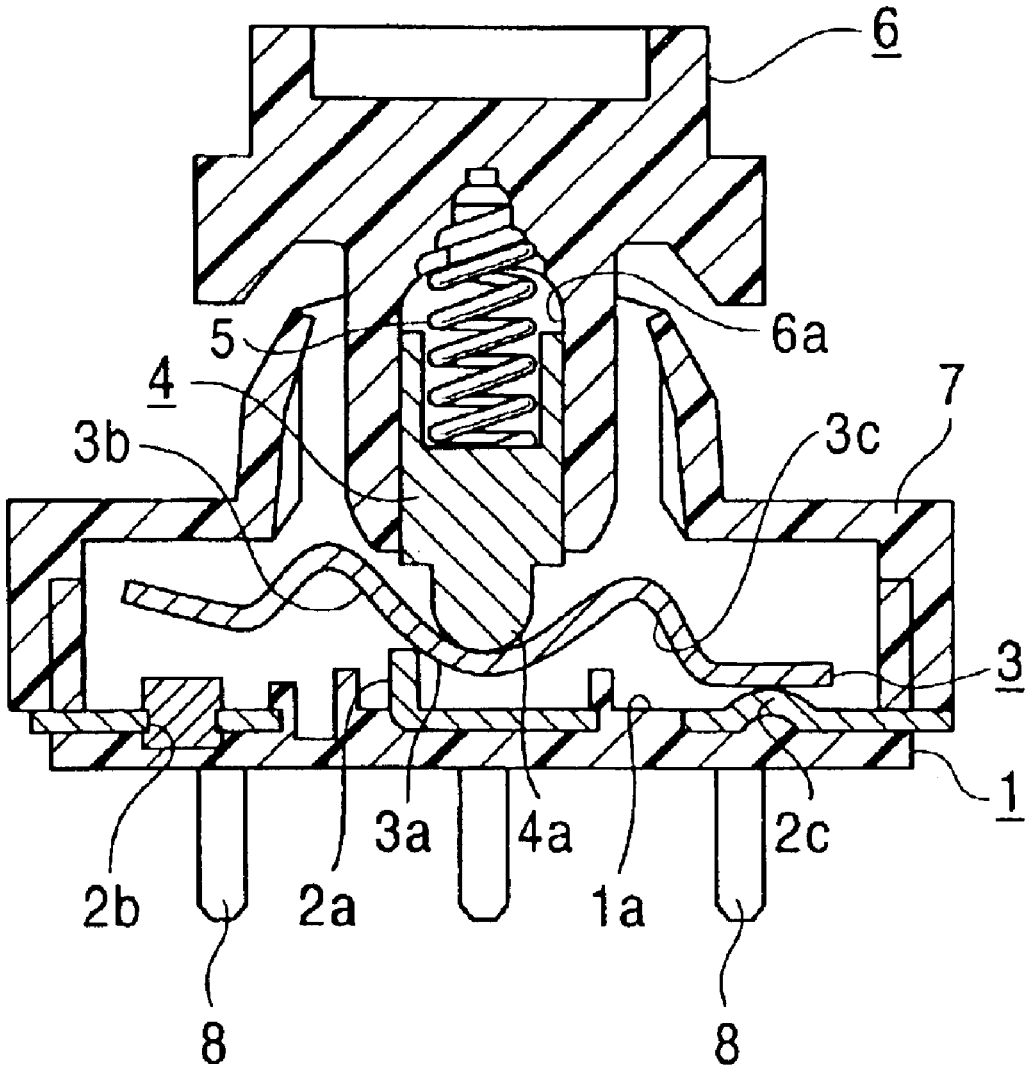
FIG. 12 PRIOR ART
FIG. 12 is a sectional view of a known switching device.

A preferred embodiment of the present invention will be described with reference to the accompanying drawings. FIG. 1 is an exploded perspective view of a switching device according to the embodiment of the present invention. FIG. 2 is a perspective view of the switching device. FIG. 3 is a plan view of the switching device in which a cover and a leaf spring are omitted. FIG. 4 is a plan view of a casing used for the switching device. FIG. 5 illustrates a non-operational state of the switching device. FIGS. 6 and 7 illustrate the states in which a conductive plate is turned and a push switch is actuated, respectively, by operating the switching device. FIG. 8 is a plan view of the switching device. FIGS. 9 and 10 are side views of the switching device viewed from its long side and short side, respectively. FIG. 11 is a bottom view of the switching device.

The switching device illustrated in these figures is used as a drive switch of a car-mounted automatic window apparatus and is a double-pole, double-throw switching device using two sets of switching elements.

The switching device is schematically formed by a casing 10 forming a pair of contact-storing spaces S1 and S2 by disposing sidewalls 10*b* and 10*c* and partitions 10*d* on a bottom wall 10*a* in a standing manner; a pair of groups of stationery contacts 11*a* to 11*c* and 12*a* to 12*c* disposed on the bottom wall 10*a* of the casing 10 by insert-molding; three terminals 13 extending from the stationery contacts 11*a* to 11*c* and protruding downwards from the casing 10; three terminals 14 extending from the stationery contacts 12*a* to 12*c* and protruding downwards from the casing 10; a pair of conductive plates 15 and 16 swingably disposed on the bottom wall 10*a* in the contact-storing spaces S1 and S2, respectively; a pair of drive bodies 17 and 18 which are disposed on the conductive plates 15 and 16 so as to be movable upwards and downwards and which are rotatable about corresponding shafts 17*a* and 18*a*, respectively; a pair of leaf springs 19 and 20 elastically urging the shafts 17*a* and 18*a* of the drive bodies 17 and 18 towards the bottom 10*a*, respectively; and a cover 21 made from a metal plate, fixed to the casing 10 so as to cover an upper opening 10*e* of the casing 10. Also, as shown in FIGS. 5 to 7, the switching device has an operating knob 22 disposed thereabove so as to be swingable about a supporting shaft 22*a*, and the operating knob 22 has a pair of pressing projections 22*b* and 22*c* disposed therein and projecting downwards therefrom so as to lie respectively above pressing actuators 17*b* and 18*b* of the drive bodies 17 and 18. In addition, a circuit board 23 with the switching device mounted thereon has a pair of push-switches (tactile switches) 24 and 25 mounted thereon next to the casing 10, and the push-switches 24 and 25 have operating units 24*a* and 25*a* disposed below the pressing actuators 17*b* and 18*b*, respectively.

The casing 10 has the two long sidewalls 10*c* which are parallel to each other, the four partitions 10*d*, and the two short sidewalls 10*b* which lie at a right angle with the long sidewalls 10*c*, all disposed on the bottom wall 10*a* in a standing manner. As shown in FIGS. 1 and 4, each of the two sidewalls 10*c* and each of two partitions 10*d* respectively have notch-shaped depressions 10*f* and 10*g* formed in the upper edges thereof (the edges close to the upper opening 10*e*) such that the shafts 17*a* and 18*a* of the drive bodies 17 and 18 are inserted in the corresponding depressions 10*f* and 10*g*, respectively, so as to be movable upwards and downwards. That is, the shaft 17*a* is inserted in the depressions 10*f* and 10*g* at the left side in FIG. 4 and the shaft 18*a* is inserted in the depressions 10*f* and 10*g* at the right side in the figure. Each of the two short sidewalls 10*b* has a notch-shaped slit 10*h* formed at the center thereof so as to be open towards the upper edge thereof. Arms 17*c* and 18*c* of the corresponding drive bodies 17 and 18 are inserted in the corresponding slits 10*h* so as to be movable upwards and downwards. In addition, each of the two sidewalls 10*c* and each of the two partitions 10*d* have respective protrusions 10*i* formed on the mutually opposing surfaces thereof, and each protrusion 10*i* has an arch shape at the upper part thereof.

The group of stationery contacts 11*a* to 11*c* is disposed in a row in the inner bottom part of the contact-storing space S1 of the casing 10, and consists of the first stationery contact 11*a*, which always remains in contact with the conductive plate 15 so as to serve as a swinging fulcrum of the contact plate 15, and the second and third stationery contacts 11*b* and 11*c* which comes into contact with or is detached from the conductive plate 15. Likewise, the group of stationery contacts 12*a* to 12*c* is disposed in a row in the inner bottom part of the contact-storing space S2 of the casing 10, and consists of the first stationery contact 12*a*, which always remains in contact with the conductive plate 15 so as to serve as a swinging fulcrum of the conductive plate 15, and the second and third stationery contacts 12*b* and 12*c* which comes into contact with or is detached from the conductive plate 16. The groups of the stationery contacts 11*a* to 11*c* and 12*a* to 12*c* are symmetrically disposed with respect to a point in a plan view. Also, the three terminals 13 extending from the corresponding stationery contacts 11*a* to 11*c* and the three terminals 14 extending from the corresponding stationery contacts 12*a* to 12*c* are all connected to an external circuit.

The conductive plate 15 is made from a metal plate and has a base 15*a* for supporting the drive body 17 which is not operated by pressing; a rising portion 15*b* having an inverted V-shape in side view and having a sloped surface continuously extending from one end of the base 15*a*; a flat portion 15*c* extending from the other end of the base 15*a*; and a movable contact 15*d* extending from the rising portion 15*b* towards the other side of the base 15*a*. The movable contact 15*d* and the flat portion 15*c* are contactable with the stationery contact 11*b* and the stationery contact 11*c*, respectively. In addition, the conductive plate 15 has two projections 15*e* formed on both longitudinal sides thereof so as to sandwich the base 15*a*, and, by engaging these projections 15*e* with the corresponding protrusions 10*i* of the casing 10, the conductive plate 15 is prevented from being displaced in the longitudinal direction thereof when it is swinging. The conductive plate 16 having the same shape as that of the conductive plate 15 has a rising portion 16*b* and a flat portion 16*c* next to both sides of a base 16*a* thereof, and has a movable contact 16*d* extending from one longitudinal end thereof. The movable contact 16*d* is contactable with the stationery contact 12*b*, while the flat portion 16*c* extending from the other longitudinal end of the conductive plate 16 is contactable with the stationery contact 12*c*. The conductive plate 16 also has two projections 16*e* formed on both longitudinal sides thereof so as to sandwich the base 16*a*, and, by engaging these projections 16*e* with the corresponding protrusions 10*i* of the casing 10, the conductive plate 16 is prevented from being displaced in the longitudinal direction thereof when it is swinging. The pair of conductive plates 15 and 16 are also disposed so as to be symmetric with respect to a point in a plan view.

The drive body 17 has the shaft 17*a*, a sliding actuator 17*d* extending downwards from the shaft 17*a*, the arm 17*c* extending sidewards from the shaft 17*a* and inserted in one of the slits 10*h*, and the pressing actuator 17*b* formed at the top of the arm 17*c* and disposed outside one of the sidewalls 10*b*. Likewise, the drive body 18 has the shaft 18*a*, a sliding actuator 18*d* extending downwards from the shaft 18*a*, the arm 18*c* extending sidewards from the shaft 18*a* and inserted in the other slit 10*h*, and the pressing actuator 18*b* formed at the top of the arm 18*c* and disposed outside the other sidewalls 10*b*. As shown in FIG. 3, these drive bodies 17 and 18 are incorporated into the casing 10 so as to be symmetric with respect to a point in plan view, and the arms 17*c* and 18*c* are disposed so as to form a straight line. That is, the drive bodies 17 and 18 are incorporated into the casing 10 such that the arms 17*c* and 18*c* are disposed in a narrow space lying between the contact-storing spaces S1 and S2 in the casing 10; the pressing actuators 17*b* and 18*b* are disposed outside the corresponding slits 10*h* which are opposed to each other and have the narrow space interposed therebetween; the shaft 17*a* is inserted in one pair of depressions 10*f* and 10*g*; and the shaft 18*a* is inserted in the other pair of depressions 10*f* and 10*g*.

Since the leaf spring 19 is fixed to the sidewalls 10*b* of the casing 10 and elastically urges the shaft 17*a* of the drive body 17 towards the bottom wall 10*a*, this urging force causes the sliding actuator 17*d* of the drive body 17 to come into elastic contact with the conductive plate 15. When the drive body 17 is turned about the shaft 17*a*, the sliding actuator 17*d* slides on the conductive plate 15 so as to turn the conductive plate 15. Likewise, since the leaf spring 20 is also fixed to the sidewalls 10*b* and elastically urges the shaft 18*a* of the drive body 18 towards the bottom wall 10*a*, this urging force causes the sliding actuator 18*d* of the drive body 18 to come into elastic contact with the conductive plate 16. When the drive body 18 is turned about the shaft 18*a*, the sliding actuator 18*d* slides on the conductive plate 16 so as to turn the conductive plate 16.

In other words, the switching device has a structure in which a first switching element having the leaf spring 19, the drive body 17, the conductive plate 15, and the group of stationery contacts 11*a* to 11*c* is disposed in the contact-storing space S1; a second switching element having the leaf spring 20, the drive body 18, the conductive plate 16, and the group of stationery contacts 12*a* to 12*c* is disposed in the contact-storing space S2; and these switching elements, are disposed side by side in the casing 10. Also, since the cover 21 has four fixing pieces 21*c* formed at the four bottom corners thereof, when these fixing pieces 21*c* are engaged with the four corners of the casing 10 by bending, the cover 21 is fixed to the casing 10 while covering the upper opening 10*e*.

An operation of the switching device having the above-mentioned structure will be described. In a non-operational state, as shown in FIG. 5, since the sliding actuator 17*d* of the drive body 17 remains in elastic contact with the upper surface of the base 15*a* of the conductive plate 15, the stationery contacts 11*a* and 11*c* are electrically connected with each other via the conductive plate 15 while the stationery contacts 11*a* and 11*b* remain in a switched-off state. In this state, since the sliding actuator 18*d* of the drive body 18 remains in electrical contact with the upper surface of the base 16*a* of the conductive plate 16, the stationery contacts 12*a* and 12*c* are electrically connected with each other via the conductive plate 16 while the stationery contacts 12*a* and 12*b* remain in a switched-off state.

In this state, when the operating knob 22 is operated by pressing so as to turn counterclockwise by a predetermined amount, since the pressing actuator 17*b* of the drive body 17 is pressed down by the pressing projection 22*b* of the operating knob 22 and hence the arm 17*c* turns counterclockwise, the sliding actuator 17*d* slides on the rising portion 15*b* of the conductive plate 15 while the shaft 17*a* is slightly raised such that the central part of the leaf spring 19 is pushed up to form an upward deflection, and the conductive plate 15 turns clockwise in the figure (see FIG. 6) upon the sliding actuator 17*d* passing through the stationery contact 11*a*. Meanwhile, in this process, since the pressing actuator 18*b* of the drive body 18 is not pressed down by the operating knob 22, the sliding actuator 18*d* remains in elastic contact with the base 16*a* of the conductor 16. Accordingly, while the terminals 14 output a non-changing signal, the terminals 13 output a switch-on change-over signal (i.e., a drive signal for performing an operation of opening a window) since the counterclockwise turning of the conductive plate 15 causes the flat portion 15*c* to be detached from the stationery contact 11*c* and the movable contact 15*d* to come into contact with the stationery contact 11*b* so that the stationery contacts 11*a* and 11*b* are electrically connected with each other via the conductive plate 15.

When the pressing operation force exerted on the operating knob 22 is removed in the state shown in FIG. 6, since the restoring force of the leaf spring 19 acts on the shaft 17*a* of the drive body 17, and the sliding actuator 17*d* slides in the reverse direction along the sloped surface of the rising portion 15*b*, the conductive plate 15 turns in the reverse direction upon the sliding portion 17*d* passing through the stationery contact 11*a*, and the switching device returns to the state shown in FIG. 5. Also, the attitude of the conductive plate 16 does not vary in this process. Accordingly, while the terminals 14 output a non-changing signal, the terminals 13 output a switch-off change-over signal since the flat portion 15*c* is detached from the stationery contact 11*b* and comes into contact with the stationery contact 11*c* so that the stationery contacts 11*a* and 11*b* are electrically disconnected from each other.

Next, an operation of the operating knob 22 which is further pressed down in the state shown in FIG. 6 will be described. In this state, the pressing actuator 17*b* is pressed further downwards by the pressing projection 22*b*, and, since the sliding actuator 17*d* slides further on the rising portion 15*b* of the conductive plate 15, the raised shaft 17*a* causes the central part of the leaf spring 19 to be further pushed up to make a further upward deflection. As a result, as shown in FIG. 7, since the pressing actuator 17*b* pushes the operating unit 24*a* into the push-switch 24 so as to actuate the push-switch 24, a drive signal for performing an operation of fully opening the window is output. When the pressing operation force exerted on the operating knob 22 is removed in the state shown in FIG. 7, since the restoring force of the leaf spring 19 causes the sliding actuator 17*d* to be pushed back along the sloped surface of the rising portion 15*b*, the switching device returns to the state shown in FIG. 5 after passing through the state in FIG. 6.

In the state shown in FIG. 5, when the operating knob 22 is turned clockwise in the figure, since the pressing actuator 18*b* of the drive body 18 is pressed down by the pressing projection 22*c* of the operating knob 22 so as to turn the arm 18*c* and thus the sliding actuator 18*d* slides on the rising portion 16*b* of the conductive plate 16, the conductive plate 16 is turned, while the conductive plate 15 is not turned. That is, since the stationery contacts 12*a* and 12*b* are electrically connected with each other, the terminals 14 output a switch-on change-over signal (i.e., a drive signal for performing an operation of closing the window). When the operating knob 22 is further pressed in this state, since the pressing projection 22*c* pushes the operating unit 25*a* into the push-switch 25 via the pressing actuator 18*b* so as to actuate the push-switch 25, a drive signal for performing an operation of fully closing the window is output. Since the first and second switching elements mutually have the same structure, and such an operation can be easily inferred from the foregoing description about the operation, its detail description will be omitted.

As described above, in this embodiment, since the leaf springs 19 and 20 elastically urge the shafts 17*a* and 18*a* of the drive bodies 17 and 18, respectively, towards the bottom wall 10*a* of the casing 10, when the pressing actuators 17*b* and 18*b* protruding sidewards from the casing 10 are selectively pressed down, the sliding actuators 17*d* and 18*d* of the drive bodies 17 and 18 slide on the sloped surfaces of the conductive plates 15 and 16 so as to turn the conductive plates 15 and 16, respectively. That is, this switching device has an advantage that the drive bodies 17 and 18 can be directly pressed down by the operating knob 22, no additional drive members are needed to be interposed between the drive bodies 17 and 18 and the operating knob 22, and, in addition, the leaf springs 19 and 20 serving as return springs can be disposed in a small space above the shafts 17*a* and 18*a*, thereby achieving a thin overall structure of the switching device. Also, since the push-switches 24 and 25 are respectively actuated by the pressing actuators 17*b* and 18*b* which are pressed down by the operating knob 22, no additional drive members for the push-switches are needed. Accordingly, in spite of the multifunctional feature of the switching device performing a manual operation and a fully opening or closing operation, the structure of the switching device does not become complicated and its advantage in a compact and thin structure is not undermined. In addition, since this switching device has the conductive plates 15 and 16, the drive bodies 17 and 18, the leaf springs 19 and 20, and the cover 21 are built on the bottom wall 10*a* of the casing 10 in that order, the switching device is easy to assemble.

Also, in the switching device according to this embodiment, when the operating knob 22 is operated by pressing, one of the drive bodies 17 and 18 is driven and the other is not subjected to the pressing force; accordingly, the conductive plates 15 and 16 have a relatively simple structure in which the bases 15*a* and 16*a* have the rising portions 15*b* and 16*b* and the flat portions 15*c* and 16*c* formed at both sides thereof, respectively. That is, although a known switching device uses a conductive plate having an approximate M-shape in plan view and having a pair of rising portions, in the conductive plate 15 (16) according to this embodiment, since the drive body 17 (18) does not slide on the surface of a portion of the conductive plate 15 (16), which extends from the base 15*a* (16*a*) towards the other side of the rising portion 15*b* (16*b*), the portion can be made so as to serve as the flat portion 15*c* (16*c*), thereby allowing the conductive plates 15 and 16 to be easily processed and to have reduced lengths.

Furthermore, in the switching device according to this embodiment, since the two groups of stationery contacts 11*a* to 11*c* and 12*a* to 12*c*, the two conductive plates 15 and 16, and the two drive bodies 17 and 18 of two sets of switching elements are respectively disposed so as to be symmetric with respect to a point in plan view, a space in the casing 10 can be effectively used and thus the entire switching device can be easily made compact. In addition, since the depressions 10*f* and 10*g* in which the shafts 17*a* and 18*a* are to be inserted so as to be movable upwards and downwards are formed in the sidewalls 10*c* and the partitions 10*d* of the casing 10, respectively, and also the slits 10*h* in which the arms 17*c* and 18*c* are to be inserted are formed in the sidewalls 10*b* of the casing 10, a space for the drive bodies 17 and 18 to be movable therein is kept while the height of the casing 10 is reduced.

When the leaf springs 19 and 20 are formed so as to cover the upper opening 10*e* of the casing 10, the cover 21 can be eliminated. Those skilled in the art will appreciate that the present invention is also applicable to a switching device having only one set of a switching element.

What is claimed is:

1. A switching device comprising:

a casing including at least one pair of opposing sidewalls formed on a bottom wall thereof in a standing manner;

at least one group of stationery contacts fixed to the casing and exposed on the bottom wall;

at least one conductive plate swingably disposed above the bottom wall and one of coming into contact with and detached from at least one of the stationery contacts;

at least one drive body which is disposed on the conductive plate so as to be movable upwards and downwards and which is turnable about a shaft of the drive body; and at least one spring elastically urging the shaft of the drive body towards the bottom wall, wherein the drive body further comprises a sliding actuator slidable on a sloped surface of the conductive plate, a pressing actuator that protrudes sidewards from the casing, and the pressing actuator is disposed so as to oppose an operating unit of a push-switch disposed in a vicinity of the casing.

2. The switching device according to claim 1, wherein the conductive plate comprises a base for supporting the drive body which has no pressing operation force acted thereon; a rising portion continuously extending from the base and having the sloped surface formed thereon; and a movable contact which extends from an end of the rising portion towards a side of the base opposing the rising portion and which is contactable with any one of the stationery contacts.

3. The switching device according to claim 2, wherein the group of stationery contacts comprises a first stationery contact always remaining in contact with the conductive plate and a second stationery contact which one of comes into contact with and is detached from the movable contact, and the first stationery contact serves as a swinging fulcrum of the conductive plate.

4. The switching device according to claim 3, wherein the group of stationery contacts further comprises a third stationery contact which one of comes into contact with and is detached from a portion of the conductive plate, the portion of the conductive plate extending from the base towards the side of the rising portion.

5. The switching device according to claim 1, wherein the casing has two sets of switching elements disposed therein side by side, each comprising the group of stationery contacts, the conductive plate, the drive body, and the spring.

6. The switching device according to claim 5, wherein the two groups of stationery contacts, the two conductive plates, and the two drive bodies of the two sets of switching elements are respectively disposed so as to be symmetric with respect to a point in plan view.

7. The switching device according to claim 6, wherein the casing has an opening opposing the bottom wall; each of a plurality of the corresponding sidewalls (former sidewalls), which are disposed in the casing in a standing manner so as to be parallel to each other, has a depression formed so as to be open towards the opening and having the shaft of the corresponding drive body inserted therein so as to be movable upwards and downwards; and each of another plurality of the corresponding sidewalls, which are disposed in the casing so as to be at a right angle with the former sidewalls, has a slit formed so as to be open towards the opening and having a portion of the corresponding drive body for supporting the pressing actuator inserted therein so as to be movable upwards and downwards.

8. The switching device according to claim 1, wherein the shaft of the drive body is movable upwards and downwards.

9. The switching device according to claim 8, wherein the shaft is rotatable.

10. The switching device according to claim 1 wherein the push-switch is disposed outside the casing.

* * * * *